US011391124B2

(12) United States Patent
Donald et al.

(10) Patent No.: US 11,391,124 B2
(45) Date of Patent: Jul. 19, 2022

(54) APPARATUS, SYSTEMS AND METHODS FOR OIL AND GAS OPERATIONS

(71) Applicant: Enpro Subsea Limited, Aberdeenshire (GB)

(72) Inventors: Ian Donald, Inverurie (GB); John Reid, Perthshire (GB); Craig McDonald, Aberdeenshire (GB)

(73) Assignee: Enpro Subsea Limited, Aberdeen (GB)

( * ) Notice: Subject to any disclaimer, the term of this patent is extended or adjusted under 35 U.S.C. 154(b) by 0 days.

(21) Appl. No.: 17/312,323

(22) PCT Filed: Dec. 11, 2019

(86) PCT No.: PCT/GB2019/053512
§ 371 (c)(1),
(2) Date: Jun. 9, 2021

(87) PCT Pub. No.: WO2020/120964
PCT Pub. Date: Jun. 18, 2020

(65) Prior Publication Data

US 2022/0025740 A1 Jan. 27, 2022

(30) Foreign Application Priority Data

Dec. 11, 2018 (GB) ..... 1820186
Dec. 12, 2018 (GB) ..... 1820278

(51) Int. Cl.
*E21B 43/013* (2006.01)
*E21B 43/017* (2006.01)

(52) U.S. Cl.
CPC ..... *E21B 43/013* (2013.01); *E21B 43/0175* (2020.05)

(58) Field of Classification Search
CPC ... E21B 43/013; E21B 43/017; E21B 43/0175
See application file for complete search history.

(56) References Cited

U.S. PATENT DOCUMENTS 8,550,170 B2 10/2013 McHugh et al.
10,947,803 B2 3/2021 Riley et al.
2004/0144543 A1* 7/2004 Appleford ..... E21B 43/36 166/336
2011/0155385 A1* 6/2011 Haheim ..... E21B 43/01 166/357
2013/0206420 A1 8/2013 McHugh et al.
2017/0067311 A1* 3/2017 Donald ..... E21B 43/013
2018/0016877 A1* 1/2018 Radicioni ..... E21B 43/017
(Continued)

FOREIGN PATENT DOCUMENTS

EP 3279429 A1 2/2018
EP 3440307 A1 2/2019
GB 2281925 A * 3/1995 ..... E21B 43/017
(Continued)

*Primary Examiner* — Matthew R Buck
(74) *Attorney, Agent, or Firm* — Holzer Patel Drennan

(57) ABSTRACT

The invention provides a subsea manifold for a subsea production system comprising at least one removable module, and methods of installation and use. The at least one removable is configured to perform a function selected from the group comprising: fluid control, fluid sampling, fluid diversion, fluid recovery, fluid injection, fluid circulation, fluid measurement and/or fluid metering.

20 Claims, 8 Drawing Sheets

(56) References Cited

U.S. PATENT DOCUMENTS

2018/0030796 A1* 2/2018 Kalia ..... E21B 43/12

FOREIGN PATENT DOCUMENTS

| | | | | |
|---|---|---|---|---|
| GB | 2549102 | A | 10/2017 | |
| WO | 2004085789 | A2 | 10/2004 | |
| WO | 2013121212 | A3 | 8/2013 | |
| WO | 2013126592 | A2 | 8/2013 | |
| WO | 2016097717 | A2 | 6/2016 | |
| WO | WO-2019008435 | A1 * | 1/2019 | ..... F16L 41/03 |

* cited by examiner

APPARATUS, SYSTEMS AND METHODS FOR OIL AND GAS OPERATIONS

The present invention relates to apparatus, systems and methods for oil and gas operations, in particular to subsea manifolds, and apparatus, systems and methods for use with subsea manifolds.

BACKGROUND TO THE INVENTION

In the field of subsea engineering for the hydrocarbon production industry, it is known to provide flow systems comprising manifolds. A subsea manifold may be connected to one or more flowlines coming from or going to other flow infrastructure, for example from or to a subsea well or multiple subsea wells. As such, a typical subsea manifold has a plurality of connectors for the tie-in of the flowlines, which may be, for example, jumper flowlines carrying production fluids from the multiple wells. Fluids which enter a subsea manifold of this type from one or more flowlines are typically then sent onwards from the manifold to a different location. For example, the fluids delivered from several subsea wells may be commingled and sent topsides via one or more flowlines.

More generally, the term "subsea manifold" may be taken to include a number of different types of subsea infrastructure, including but not limited to a subsea Christmas tree, a subsea collection manifold system, a subsea well gathering manifold, a subsea distributed manifold system (such as an in-line tee (ILT)), a subsea Pipe Line End Manifold (PLEM), a subsea Pipe Line End Termination (PLET) and a subsea Flow Line End Termination (FLET).

During the development and life-span of subsea hydrocarbon fields, it is often the case that new hydrocarbon discoveries are made and/or further tie-ins to the flow system infrastructure are required. As such, typical subsea well gathering manifolds may be provided with surplus connectors, to accommodate future tie-in requirements. However, such manifolds tend to demand a large initial capital expenditure because they are fully equipped with all of the equipment, instrumentation and valving needed to facilitate the tie-in and production of the future wells.

Whatever the type of subsea manifold, if the internal equipment, instrumentation and/or valving within the manifold is to fail, in order to repair or replace these parts the entire manifold must be recovered. This typically requires large vessels, is expensive, disruptive and potentially damaging to the surrounding subsea infrastructure, and disruptive to production operations.

SUMMARY OF THE INVENTION

It is amongst the aims and objects of the invention to provide a subsea manifold and method of use which mitigates drawbacks of prior art subsea manifolds and methods of use.

It is amongst the aims and objects of the invention to provide an apparatus, system and a method of use for providing fluid control, fluid measurement and/or intervention in a flow system of an oil and gas production installation, which is an alternative to the apparatus and methods described in the prior art.

It is amongst the aims and objects of the invention to provide an apparatus, system and a method of use for providing fluid control, fluid measurement and/or intervention in an oil and gas production installation, which addresses one or more drawbacks of the prior art.

An object of the invention is to provide a flexible apparatus, system and method of use suitable for use with and/or retrofitting to industry standard or proprietary oil and gas manifolds.

Further objects and aims of the invention will become apparent from the following description.

According to a first aspect of the invention, there is provided a subsea manifold configured for connection to a subsea production system, the subsea manifold comprising:

at least one removable module;

wherein the at least one removable module is configured to perform one or more functions selected from the group comprising: fluid control, fluid sampling, fluid diversion, fluid recovery, fluid injection, fluid circulation, fluid access, fluid measurement, flow measurement and/or fluid metering.

The subsea manifold may be a subsea manifold selected from the group comprising: a subsea Christmas tree; a subsea collection manifold system; a subsea distributed manifold system such as an in-line tee (ILT); a subsea Pipe Line End Manifold (PLEM); a subsea Pipe Line End Termination (PLET); and a subsea Flow Line End Termination (FLET).

The manifold may comprise a plurality of removable modules.

The at least one removable module may be pre-installed on the subsea manifold and left in situ at a subsea location for later performance of a subsea operation.

The subsea manifold may be provided with alternative and/or additional removable modules. Such additional or alternative modules may be provided to the manifold at any time.

Fluid measurement may comprise measurement of a temperature and/or a pressure of a fluid.

The at least one removable module may be retrievable. Preferably the removable module is retrievable to the surface. The removable module may be replaced with or swapped for an alternative removable module.

The manifold may comprise one or more fluid access points which may be configured to connect to a removable module. The manifold may comprise flowlines and the one or more fluid access points may be in fluid communication with the flowlines.

The one or more fluid access points may be provided with flow caps when not in use (i.e. when not currently being used to accommodate or receive a removable module).

The one or more fluid access points may be single bore fluid access points. Alternatively, or in addition, the one or more fluid access points may be dual bore and/or a multi-bore fluid access points.

The removable module may comprise a number of bores which corresponds to the number of bores of the fluid access point to which it is required to connect. Multiple removable modules may be provided with alternative bore configurations for multiple fluid access points of complimentary bore configurations.

The removable module may comprise a connector configured to be connected to the subsea production flow system. The connector may be configured to be connected to a flowline of the subsea production flow system (such as a jumper flowline).

According to a second aspect of the invention there is provided a subsea manifold for a subsea oil and gas production system, the subsea manifold comprising:

at least one connection location for a subsea well;

at least one outlet; and at least one fluid access point between the connection location and the outlet;

wherein the manifold structure defines a first flow path between the connection location and the at least one access point and a second flow path between the at least one access point and the outlet; and wherein the at least one access point is configured to receive a removable module.

The at least one fluid access point may be a single bore access point. Alternatively, or in addition, the at least one access point may be a dual bore and/or a multi-bore access point.

Embodiments of the second aspect of the invention may include one or more features of the first aspect of the invention or its embodiments, or vice versa.

According to a third aspect of the invention there is provided a removable module for a subsea manifold of a subsea production system, the removable module comprising: at least one connector configured to connect the module to the subsea manifold; wherein the removable module is configured to perform a function selected from the group comprising: fluid control, fluid sampling, fluid diversion, fluid recovery, fluid injection, fluid circulation, fluid access, fluid measurement, flow measurement and/or fluid metering.

The removable module may comprise an external connector configured to be connected to the subsea production flow system.

The external connector may be configured to be connected to a flowline of the subsea production flow system (such as a jumper flowline).

The external connector may be operable to route production flow from the manifold onwards, into the production flow system.

Alternatively, or in addition, the removable module may comprise a plurality of connectors configured to connect the module to the subsea manifold, such that the module may be in fluid communication with one or more flow paths within the manifold and much that the module may receive flow from and/or direct flow back into the manifold.

Embodiments of the third aspect of the invention may include one or more features of the first aspect or the second aspect of the invention or their embodiments, or vice versa.

According to a fourth aspect of the invention there is provided a removable module for a subsea manifold of a subsea oil and gas production system, the removable module comprising:

a body; and at least one connector configured to connect the removable module to the subsea manifold;

wherein the body defines at least one flow path from the at least one connector configured to be in fluid communication with one or more flow paths of the subsea manifold.

Embodiments of the fourth aspect of the invention may include one or more features of the first to third aspects of the invention or their embodiments, or vice versa.

According to a fifth aspect of the invention, there is provided a subsea oil and gas production installation, the installation comprising:

a subsea production system;

a subsea manifold defining one or more flow paths and comprising at least one connection location for the subsea production system and at least one fluid access point; and a removable module;

wherein the subsea manifold is fluidly connected to the subsea production system at the at least one connection location;

wherein the removable module is connected to the at least one fluid access point of the subsea manifold; and wherein the at subsea production system and the removable module are each in fluid communication with a flow path of the one or more flow paths.

Embodiments of the fifth aspect of the invention may include one or more features of the first to fourth aspects of the invention or their embodiments, or vice versa.

According to a sixth aspect of the invention, there is provided a subsea oil and gas production installation, the installation comprising:

at least one subsea well;

a subsea manifold defining one or more flow paths and comprising at least one connection location for a subsea well and at least one fluid access point; and a removable module;

wherein the at least one subsea well is fluidly connected to the subsea manifold at the at least one connection location;

wherein the removable module is connected to the at least one fluid access point of the subsea manifold; and wherein the at least one subsea well and the removable module are each in fluid communication with a flow path of the one or more flow paths.

Embodiments of the sixth aspect of the invention may include one or more features of the first to fifth aspects of the invention or their embodiments, or vice versa.

According to a seventh embodiment of the invention, there is provided a method of installing a removable module to a pre-installed subsea manifold, the method comprising: providing a pre-installed subsea manifold comprising a connector connected to a pre-installed flow component, flow line, module or piece of equipment; and providing a removable module comprising at least one connector.

removing the pre-installed flow component, flow line, module or piece of equipment from the connector of the subsea manifold; and coupling the at least one connector of the removable module to the connector of the subsea manifold.

Embodiments of the seventh aspect of the invention may include one or more features of the first to sixth aspects of the invention or their embodiments, or vice versa.

According to an eighth embodiment of the invention, there is provided a method of installing a removable module to a pre-installed subsea manifold, the method comprising:

providing a pre-installed subsea manifold comprising a connector connected to a pre-installed flowline; and providing a removable module comprising at least two connectors;

removing the pre-installed flowline from the connector of the subsea manifold;

coupling a first connector of the at least two connectors of the removable module to the connector of the subsea manifold; and coupling the pre-installed flowline to a second connector of the at least two connectors of the removable module.

The pre-installed flowline may be a production flowline and may be an export flowline. More specifically, the pre-installed flowline may be a flexible or a rigid jumper flowline.

The removable module may be configured to perform one or more functions selected from the group comprising: fluid control, fluid sampling, fluid diversion, fluid recovery, fluid injection, fluid circulation, fluid access, fluid measurement, flow measurement and/or fluid metering.

The removable module may comprise a flow path between the at least two connectors.

The removable module may be a fluid and/or a flow measurement removable module. The removable module may comprise transducers (or sensors) for measuring fluid properties such as pressure and/or temperature and/or for measuring properties such as flow rate. Such transducers (or sensors) may be in direct communication with the flow path of the retrievable module.

Alternatively, or in addition, the removable module may not perform any of the above functions. Instead, the removable module may act as a spacer module which includes a flow path between its at least two connectors which may allow fluid to flow therethrough.

The pre-installed flowline may be connected to an outlet connector of the subsea manifold. The method may comprise installing the removable module on the outlet connector of the subsea manifold.

The pre-installed flowline may be connected to an inlet connector of the subsea manifold. The method may comprise installing the removable module on the inlet connector of the subsea manifold.

Embodiments of the eighth aspect of the invention may include one or more features of the first to seventh aspects of the invention or their embodiments, or vice versa.

According to a ninth aspect of the invention there is provided a subsea manifold for a subsea oil and gas production flow system, the subsea manifold comprising:

at first connector configured to be fluidly connected to a subsea well;

a second connector configured to be fluidly connected to the subsea production flow system;

a flowline header in fluid communication with the second connector; and a fluid access point located between the first connector and the flowline header and having first and second flow access openings;

wherein the manifold structure defines a first flow path between the first connector and the first flow access opening of the fluid access point and a second flow path between the second flow access opening of the fluid access point and the flowline header;

wherein the fluid access point is configured to be connected to a removable module comprising a flow path for connecting the first and second fluid access openings such that the subsea well and the subsea production flow system are fluidly connected by the removable module.

The subsea manifold may be a subsea Christmas tree, a subsea collection manifold system, a subsea well gathering manifold, a subsea distributed manifold system (such as an in-line tee (ILT)), a subsea Pipe Line End Manifold (PLEM), a subsea Pipe Line End Termination (PLET) and a subsea Flow Line End Termination (FLET).

The first connector may be configured to be connected to a flowline (such as a jumper flowline) to fluidly connect it to the subsea well. Various flow components (such as flowlines and connectors) may be positioned between the first connector and the subsea well.

The first connector may be configured to receive production fluid from a subsea well. The first connector may be configured to route a fluid into the subsea well. The first connector may be configured to deliver gas into the subsea well, for the execution of gas lift operations.

The manifold may comprise additional connectors configured to be fluidly connected to additional subsea wells.

The second connector may be configured to be fluidly connected to a flowline of the subsea production flow system (such as a jumper flowline). The second connector may be configured to be connected to an export production flowline of the flow system which may transport production fluid to the surface. The second connector may be configured to be connected to a gas delivery flowline.

The manifold may comprise additional connectors configured to be connected to the subsea production flow system.

The flowline header may be a production flowline header. Alternatively, the flowline header may be a gas lift flowline, also referred to throughout as a gas lift header or a gas lift flowline header. The manifold may comprise a plurality of flowline headers, and the plurality of flowline headers may comprise production headers, gas lift headers or a combination of production headers and gas lift headers.

The fluid access point comprising first and second flow access openings may be referred to as a dual bore fluid access point. The fluid access point may comprise more than two flow access openings and may be a multi-bore fluid access point.

The manifold may comprise additional fluid access points. The manifold may comprise fluid access points which may provide dual bore or multi-bore access to a flowline header.

The fluid access point or points may be provided with flow caps when not in use (i.e. when not currently being used to accommodate or be connected to a removable module). In this state, and when no removable modules are present, there cannot be flow between a subsea well and a flowline header of the manifold because no flow path exists between them. The flow path or paths that links these components is provided by the removable module(s).

The removable module may comprise additional flow paths. The flow path or paths of the removable module may comprise one or more valves. The removable module may selectively fluidly connect the subsea well and the subsea production flow system by operation of the one or more valves provided in the flow path or paths of the removable module.

The removable module may comprise equipment or instrumentation which may be operable to monitor the properties of the fluid flowing therethrough (such as transducers and/or flow meters). The removable module may comprise one or more fluid access points in fluid communication with its flow path and/or one of its paths. The one or more fluid access points may provide a location for accessing the fluid in the manifold and hence the subsea well and/or production system to perform fluid intervention operations.

The manifold may comprise a third connector configured to be fluidly connected to the subsea production flow system. The manifold may comprise a second flowline header in communication with the third connector. The fluid access point may comprise a third flow access opening. The manifold may define a third flow path between the third flow access opening of the fluid access point and the second flowline header. The fluid access point may be configured to be connected to a removable module comprising a first flow path for connecting the first and second fluid access openings such that the subsea well and the first flowline header are fluidly connected by the first flow path of the removable module and a second flow path for connecting the first and third fluid access openings such that the subsea well and the second flowline header are fluidly connected by the second flow path of the removable module. The first and second flow paths of the removable module may be fluidly connected.

The manifold may comprise a third connector configured to be fluidly connected to the subsea well. The manifold may comprise a fourth connector configured to be fluidly connected to the subsea production flow system. The manifold may comprise a second flowline header in communication with the fourth connector. The fluid access point may comprise third and fourth flow access openings. The manifold may define a third flow path between the third connector and the third flow access opening of the fluid access point and a fourth flow path between the fourth flow access opening of the fluid access point and the second flowline header. The fluid access point may be configured to be connected to a removable module comprising a first flow path for connecting the first and second fluid access openings such that the subsea well and the first flowline header are fluidly connected by the first flow path of the removable module and a second flow path for connecting the third and fourth fluid access openings such that the subsea well and the second flowline header are fluidly connected by the second flow path of the removable module. The first flowline header may be a production flowline header and the second flowline header may be a gas lift flowline header.

Embodiments of the ninth aspect of the invention may include one or more features of the first to eighth aspects of the invention or their embodiments, or vice versa.

According to a tenth aspect of the invention there is provided a removable module for fluidly connecting flow paths within a subsea manifold of a subsea oil and gas production system, the removable module comprising:

a body;

a first connector; and a second connector;

wherein the first and second connectors are configured to be connected to first and second flow access openings of an access point of the subsea manifold, respectively; and wherein the body defines a flow path between the first connector and the second connector.

The removable module may comprise additional connectors. The removable module may comprise additional flow paths. The flow path or paths of the removable module may comprise one or more valves. The removable module may selectively fluidly connect a subsea well and a subsea production flow system by operation of the one or more valves provided in the flow path or paths of the removable module.

The removable module may comprise equipment or instrumentation which may be operable to monitor the properties of the fluid flowing therethrough (such as transducers and/or flow meters). The removable module may comprise one or more fluid access points in fluid communication with its flow path and/or one of its flow paths. The one or more fluid access points may provide a location for accessing the fluid in the manifold and hence may provide access to the subsea well and/or the subsea production system to perform fluid intervention operations.

Embodiments of the tenth aspect of the invention may include one or more features of the first to ninth aspects of the invention or their embodiments, or vice versa.

According to an eleventh aspect of the invention, there is provided a subsea oil and gas production installation, the installation comprising:

at least one subsea well and a subsea production flow system;

a subsea manifold according to the ninth aspect of the invention; and a removable module;

wherein the first connector of the subsea manifold is fluidly connected to the subsea well and the second connector of the subsea manifold is fluidly connected to the subsea production flow system;

wherein the removable module comprises a first connector connected to the first flow access opening of the fluid access point of the manifold and a second connector connected to the second opening of the fluid access point of the manifold;

wherein the removable module defines a flow path between its first and second connectors such that the subsea well and the subsea production flow system are fluidly connected by the removable module.

Embodiments of the eleventh aspect of the invention may include one or more features of the first to tenth aspects of the invention or their embodiments, or vice versa.

According to a twelfth aspect of the invention, there is provided a method of controlling flow between a subsea well and a subsea production system, the method comprising: providing a subsea oil and gas production installation according to the eleventh aspect of the invention, wherein the removable module comprises at least one valve in the flow path between its first and second connectors;

operating the at least one valve to selectively permit fluid to flow from the subsea well to the subsea production flow system and/or from the subsea production flow system to the subsea well.

The flowline header may be a production flowline header and the method may comprise operating the at least one valve to control flow of production fluid from the subsea well to the production flowline header and subsea production system.

Alternatively, or in addition, the flowline header may be a gas lift flowline header and the method may comprise operating the at least one valve to control flow of gas flow from the gas lift flowline header to the subsea well.

The manifold may comprise a third connector configured to be fluidly connected to the subsea production flow system and a second flowline header in communication with the third connector. The first and second flowline headers may be production flowline headers. The fluid access point may comprise a third flow access opening and the manifold may define a third flow path between the third flow access opening of the fluid access point and the second flowline header. The removable module may comprise a second flow path for connecting the first and third fluid access openings such that the subsea well and the second flowline header are fluidly connected by the second flow path of the removable module. The second flow path may comprise at least one valve. The method may comprise operating the at least one valve in the first flow path of the removable module and/or the at least one valve in the second flow path of the removable module to control whether fluid from the subsea well flows into the first and/or the second production flowline headers.

The manifold may comprise a third connector configured to be fluidly connected to the subsea well and a fourth connector configured to be fluidly connected to the subsea production flow system. The first flowline header may be a production flowline header and the manifold may comprise a second flowline header in communication with the fourth connector. The second flowline header may be a gas lift flowline header. The fluid access point may comprise third and fourth flow access openings and the manifold may define a third flow path between the third connector and the third flow access opening and a fourth flow path between the fourth flow access opening and the second flowline header.

The removable module may comprise a second flow path for connecting the third and fourth fluid access openings such that the subsea well and the second flowline header are fluidly connected by the second flow path of the removable module. The method may comprise operating the at least one valve in the first flow path of the removable module to selectively permit production fluid to flow from the subsea well to the subsea production flow system via the production flowline header. The second flow path may comprise at least one valve, and the method may comprise operating the at least one valve in the second flow path of the removable module to selectively control the flow of gas flow from the gas lift flowline header to the subsea well.

Embodiments of the twelfth aspect of the invention may include one or more features of the first to eleventh aspects of the invention or their embodiments, or vice versa.

According to a thirteenth aspect of the invention, there is provided a method of connecting a new subsea well to a subsea production system, the method comprising:

providing a subsea well, a subsea production flow system and a subsea manifold according to the ninth aspect of the invention;

wherein second connector of the subsea manifold is fluidly connected to the subsea production flow system; and wherein the fluid access point of the subsea manifold is provided with a flow cap;

fluidly connecting the subsea well to the first connector of the subsea manifold;

removing the flow cap from the fluid access point of the subsea manifold; and connecting a removable module according to the tenth aspect of the invention to the fluid access point of the module such that the subsea well and the subsea production flow system are fluidly connected by the removable module.

Embodiments of the thirteenth aspect of the invention may include one or more features of the first to twelfth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
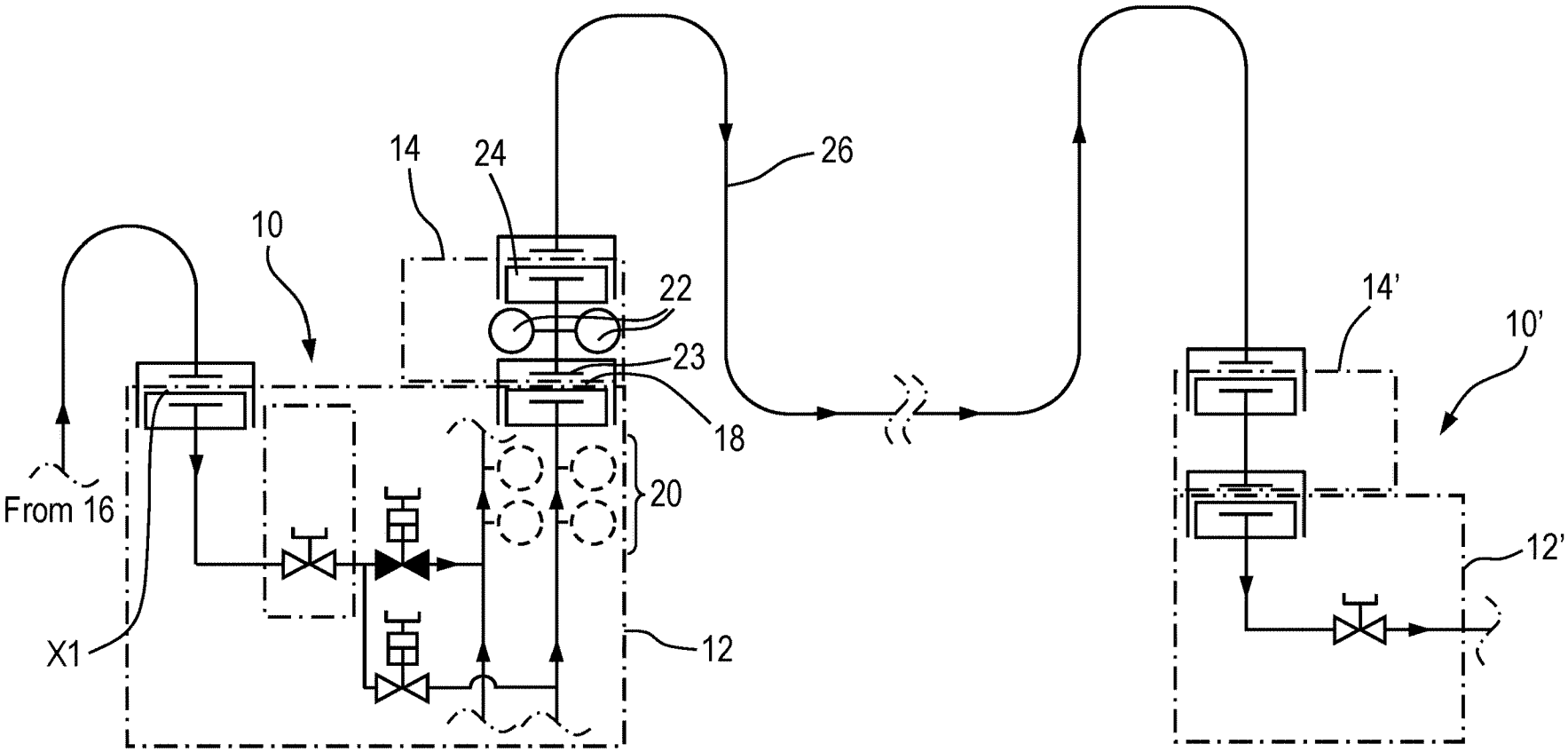
FIG. 1 is a schematic side view of a subsea production system according to a first embodiment of the invention.

Referring firstly to FIG. 1, there is shown, generally at 10, a subsea production manifold. The manifold 10 comprises a main manifold structure 12 and a removable module 14.

The main manifold structure 12 is a typical base manifold structure including one or more subsea well tie-in connection locations, a series of internal flowlines, and one or more outlets for production fluid to exit the manifold. The manifold 10 in question also includes an arrangement of valves.

One of the subsea well tie-in connection locations is shown at X1. Here, the manifold 10 receives production fluid from a subsea Christmas tree 16 (not shown) of a subsea well. In addition, a single-bore flow outlet connector is shown at 18. However, it will be appreciated that numerous outlets and/or access points may be provided on the manifold which may also comprise dual-bore and/or multi-bore arrangements.

Typical subsea production manifolds contain instrumentation for monitoring the properties of the production fluid flowing therethrough (for example, pressure transducers for monitoring pressure, temperature transducers for monitoring temperature, and flow meters for monitoring flow rate, amongst other things). However, such instrumentation has a tendency to fail and/or has a generally shorter life-span than that of the manifold, and in order to repair or replace the instrumentation, it would be necessary to recover the entire manifold in an operation which would cause substantial disruption to the surrounding subsea production system and infrastructure.

Therefore, it is desirable to be able to provide this functionality in removeable modules which can be individually recovered for repair or replacement should a failure occur.

FIG. 1 shows, in dashed lines at 20, the location of pressure/temperature transducers within the manifold 10 which were used to take pressure and temperature measurements of the production fluid. However, in the present embodiment of the invention, the transducers 20 have failed and are unable to perform their function as intended. As such, this functionality has been added out with to the main manifold structure 12 and provided instead in removable module 14.

Following an operation to lift the pre-existing rigid jumper flowline 26 from the outlet connector 18 of the manifold, the removable module 14 is installed. The removable module 14 has been landed on and connected to the manifold at the outlet connector 18, such that in use production fluid flows through the module 14 upon exiting the main manifold structure 12. The module 14 defines a single flow bore between upper and lower connectors 23, 24, respectively, and pressure/temperature transducers 22 in communication with the flow bore. Therefore, the module 14 provides the measurement functionality which would, in a typical working manifold, be provided within the main manifold structure. The upper connector 24 of the module 14 is substantially identical to the outlet connector 18 of the manifold 10 itself, such that an onward flowline—which is, in this case, a rigid jumper flowline 26—can connect to the module 14 in the same manner as it would connect to the manifold 18. This avoids the requirement for modifications to be made to the production system flow infrastructure, thus saving time and expense.

In the configuration shown in FIG. 1, production flow is routed through the rigid jumper flowline 26 upon exiting the manifold 10, and in to a further manifold 10'. The further manifold 10' is a Pipe Line End Termination (PLET) and comprises a main manifold structure 12' and removable module 14'. The removable module 14' differs from the module 14 in that it provides only a single flow bore between its upper and lower connectors, with no additional functionality. The purpose of the module 14 is simply to act as a spacer between the manifold 10' and the rigid flowline 26 and is required in this instance for flowline geometry reasons due to the addition of the transducer module 14.

Figure 2A:
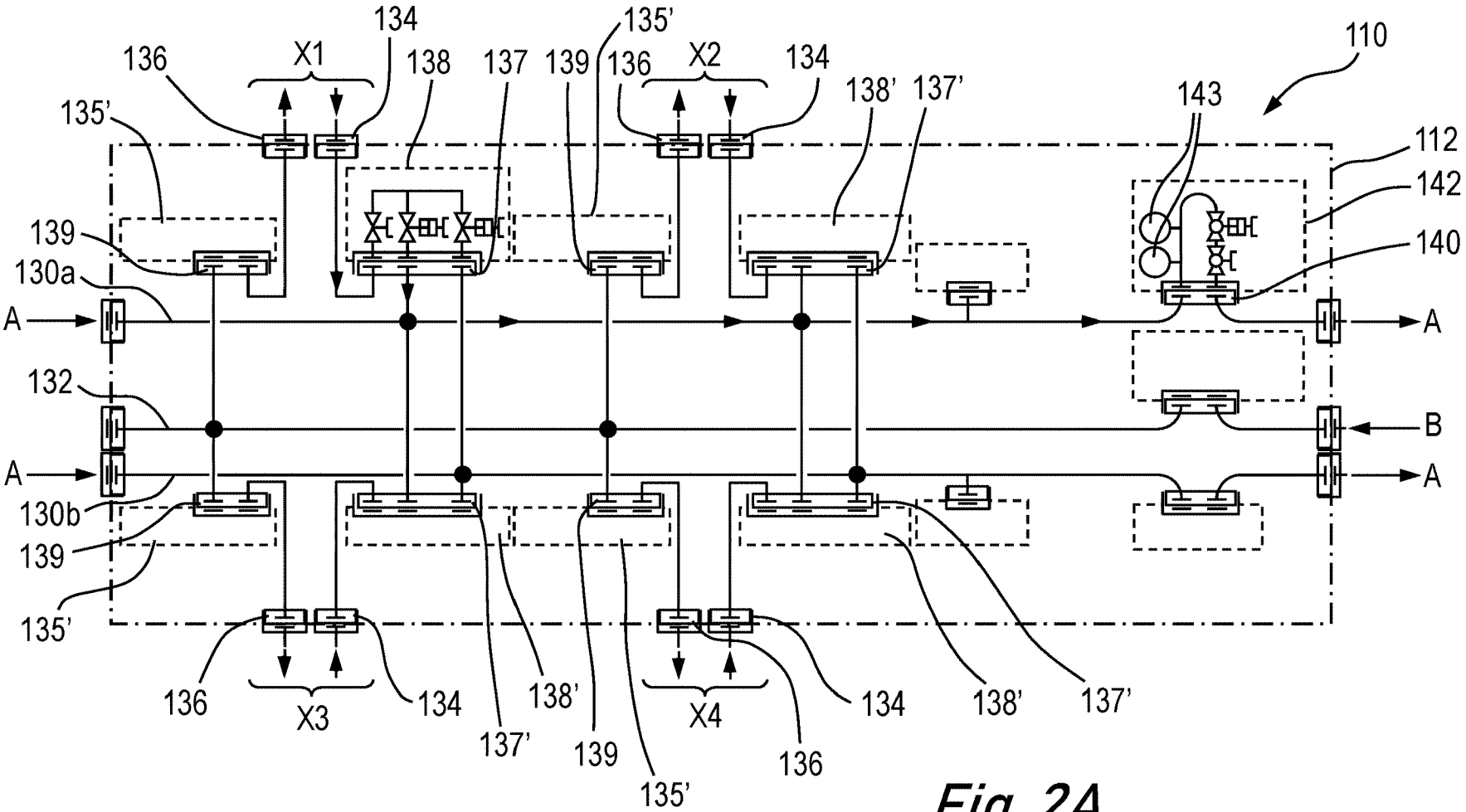
FIGS. 2A and 2B are schematic plan views of a subsea manifold according to an alternative embodiment of the invention.

Referring now to FIG. 2A there is shown, generally at 110, a subsea well gathering manifold comprising a main manifold structure 112 and a one or more removable modules. The main manifold structure 112 is a typical, passive base structure which includes only the necessary piping and flowline headers for the connection and tie-in of multiple subsea wells, and for onward transportation from the manifold of production fluid to the surface and/or to a storage or processing facility.

The manifold 110 is a so-called "twin header" manifold, which comprises two main production flowline headers 130*a* and 130*b*. Production fluid from one or more subsea wells which are connected to the manifold 110 is operable to join and flow through either or both of the production flowline headers 130*a*, 130*b*. The production flowline headers 130*a*, 130*b* of the manifold 110 may also be connected to and/or continuous with incoming production flowlines (not shown) which flow into the manifold 110 in the direction of arrows A. Flow from the wells and the production flowline headers 130*a*, 130*b* exits the manifold through the production flowline headers 130*a*, 130*b* in the direction of arrows A', into one or more export production flowlines (not shown) which transport the fluid to the surface and/or for onward storage or processing. The manifold also comprises a gas lift flowline header 132 into which gas can be delivered from the surface and/or from a storage or injection facility to the manifold 110—and subsequently into one or more of the subsea wells which are connected to the manifold 110—for gas lift operations to assist with the recovery of hydrocarbons.

In the configuration shown, the manifold 110 has the capacity to be connected to up to four subsea wells. The four subsea well tie-in connection locations are shown generally at X1, X2, X3 and X4. Each connection location X1, X2, X3 and X4 comprises two flowline connectors: a connector 134 to receive production fluid from the subsea tree of a subsea well (either directly or via one or more flowlines and/or additional subsea infrastructure) and a connector 136 for the delivery of gas to a subsea well for gas lift operations. In FIG. 2A, the connection locations X2, X3 and X4 are shown with flow caps installed thereon, as they are not connected to any wells. As such, there can be no flow from connection locations X2, X3 or X4 to any of the flowline headers, because no flow path presently exists between them. The connector 136 of connection location X1 has also been provided with a flow cap. However, the connector 134 of connection location X1 is connected to a subsea Christmas tree of a first subsea well (not shown) such that the manifold 110 can receive production fluid flowing from the well. As the connector 136 has been capped, the subsea Christmas tree and well in question are not currently engaged for gas lift operations.

In use, production fluid which flows into the manifold 10 from one or more subsea wells via the connectors 134 at connection locations X1, X2, X3 and X4 will be routed into either (or both) of the production flowline headers 130*a*, 130*a* by removable modules on the main manifold structure 112 (described in more detail below). This may also be assisted by an arrangement of valves provided in the removable modules. In the absence of the removable modules, no flow path exists between the subsea wells and the production headers.

Likewise, gas which flows into the manifold 110 is directed from the gas lift flowline header 132 and into one or more subsea wells via the connectors 136 by an arrangement of removable modules (not currently shown in this Figure) on the main manifold structure 112 at access points 139 (currently provided with flow caps) and valves provided therein. Dashed lines 135' have been included to provide an indication of how and where such removable modules would attach to the manifold structure 112. Again, without the removable modules there is no flow path between the subsea wells and the header flowlines within the manifold.

As mentioned above, the valves of the manifold 110 which are required for routing the production fluid from the wells and into the production flowline headers 130*a*, 130*b* are not provided within the main manifold structure 112. Instead, they are provided in removable modules which can be landed on and connected to the manifold structure 112 at discrete access points 137 (and 137'). Most of these access points are currently shown provided with flow caps at 137' and dashed lines 138' have been included to provide an indication of how and where some of these removable modules would attach to the manifold structure 112.

As a first well is connected to the connector 134 of connection location X1, routing of the production fluid from this well, through the manifold, will be described to provide an example of how the manifold works in use. Production fluid from the well enters the manifold 110 at the connector 134 and a multi-bore removable module 138 containing the required valves is provided on access point 137. The valves within this module 138 are operable to route production flow to production flowline header 130*a*, production flowline header 130*b*, or both. In FIG. 2A, the access point 137 has three flow access bores/connectors and the removable module 138 is also provided with three flow access bores/connectors which correspond with the access point 137. However, in alternative arrangements of the invention, a removable module with a different number of access bores to an access point may be provided. For example, a removable module having two access bores corresponding to only two of the access bores of a three bore access point 137 could be provided. In this case, the module might contain a flow cap or blank to shut off the third unused module. This sort of arrangement may be provided when production is only required through one of the production headers.

In some embodiments, the connection locations for the subsea wells may be provided directly on the removable modules, instead of on the manifold (or a combination of these two arrangements may be provided) and the removable modules may function to route said flow into or from the flowline headers as otherwise described throughout.

In this example, the valves of module 138 are configured to route production flow to production flowline header 130*a*. Flow from the well connected at connection location X1 flows into the flowline header 130*a* in the manner described, by operation of the valves, and continues along the production header until it reaches arrives at a flow access point 140 on the flowline header 130*a*. 140 is a dual-bore access point which facilitates the landing and connection of dual-bore removable module 142. This module contains instrumentation for measuring the temperature and the pressure of the production fluid flowing within flowline header 130*a*, as well as a number of valves.

Although only the provision of valves and instrumentation is described above, any additional flow intervention, measuring and control instrumentation and/or equipment required by the manifold may also be provided in this way (that is, not as part of the main manifold structure, but in removable modules).

Therefore, unlike typical subsea oil and gas manifolds, the manifold 110 does not include any valves, sensors, other instrumentation or equipment. Instead, these functional elements are provided separately, integrated into one or more removable modules which can be landed on and connected to the manifold at various locations.

By providing valving, instrumentation and other equipment in removable modules, instead of being integral to the manifold, a number of advantages are realised. For example, this allows for the provision of a simple, standard manifold structure which can be modified depending on desired functions or requirements by selecting appropriate removable modules for connection to the manifold. In addition, the function of such a manifold can be altered at any time by changing the removable modules connected to it. This can be done without disturbing the manifold itself, and without disturbing the greater flow system to which it is connected.

In situations in which, initially, only one or a small number of wells are to be connected to the manifold, the manifold can be populated with removable modules containing the valving, instrumentation and equipment only required for this precise number of wells. In this way, initial capital expenditure can be reduced, yet the option to further populate the manifold and tie-in additional subsea wells in the future remains open.

With the functional elements of the manifold being provided in removable modules, repair and replacement is also made simpler, easier and cheaper. For example, specific modules can be retrieved, repaired and/or replaced where necessary without having to alter the entire manifold structure.

This also allows for a change in purpose or functionality and provides the flexibility to integrate emerging technologies into the flow system in the future, which could aid with reservoir management and increased recovery.

Figure 2B:
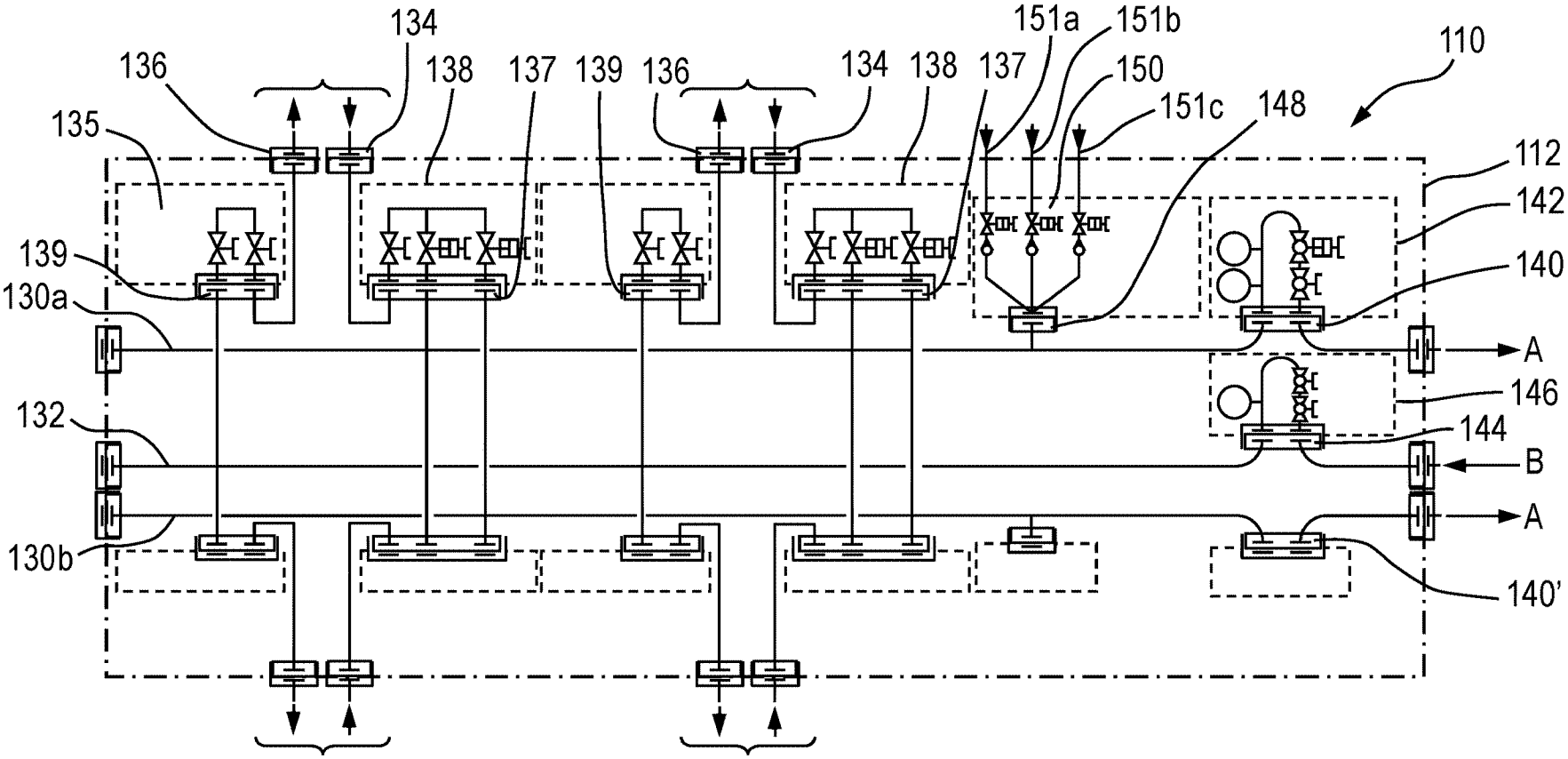

Referring now to FIG. 2B, the same manifold 110 of FIG. 2A is shown. However, two wells have now been connected to the manifold 110 at connection locations X1 and X2. The wells have been connected using both connectors 134 and 136 at each connection location, and the manifold structure 112 has been populated with removable modules at the X1 and X2 connection location access points 137, 139 containing the necessary valving and equipment required to send production fluid from the wells onward to the surface and/or for storage or processing and the necessary valving required to facilitate the delivery of gas for a gas lift operation to either or both of the wells connected at X1 and/or X2.

Fluid is produced from the wells in the same manner that is described with reference to FIG. 2A. In addition, gas flowing in the manifold can now be directed from the gas lift flowline header 132 and into the subsea wells connected at locations X1 and X2, via the connectors 136, by the arrangement of valves provided in removable modules 135.

The gas lift flowline header comprises a dual bore flow access point 144, similar to the access point 140 and 140' on the production flowline headers 130*a* and 130*b*. Access point 144 facilitates the landing and connection of dual-bore removable module 146 to the manifold structure 112. Again, like the module 142, this module contains instrumentation for measuring the temperature and the pressure of the gas flowing into the gas lift flowline header 132 of the manifold, as well as two valves.

In FIG. 2B, the manifold has also been provided with an additional removable module upon a single bore access point 148, which is in fluid communication with production flowline header 130*a*. The additional module 150 is a chemical injection module comprising three main injection flowlines 151*a*, 151*b* and 151*c* through which chemicals can be introduced to the production flowline header 130*a*. Valves contained within the module 150 can control which (if any) injection flowlines are brought into fluid communication with the flowline header 130*a* in order to carry out chemical injection operations as and when required. The addition of such a module may only be temporary and may only occur as and when required.

Figure 2C:
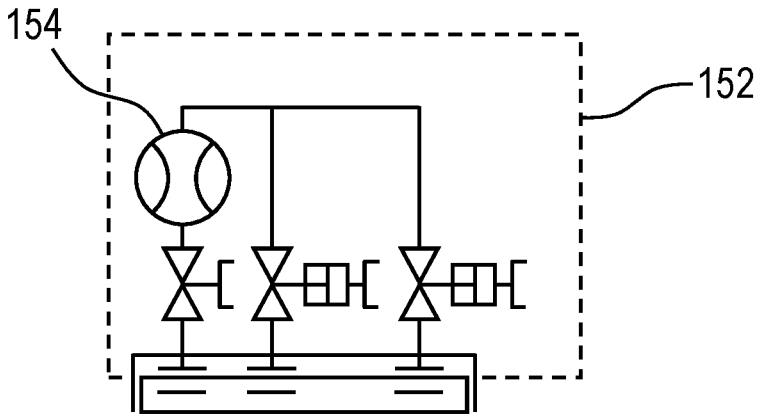
FIG. 2C is a schematic view of a removable module according to an alternative embodiment of the invention.

As the modules of the manifold 110 can be removed and replaced with relative ease, the functionality of the manifold 110 can be tailored and enhanced by simply adding, removing or swapping a module, as applicable. For example, FIG. 2C shows an alternative module 152 which could be used in place of the multi-bore removable module 138 shown in FIGS. 2A and 2B, which is operable to route production fluid from one or more wells to either or both of the production headers. The module 152 differs from the module 138 in that it also comprises a multi-phase flow meter 154 to provide the manifold with the additional functionality of performing flow rate measurements for individual phases of the production fluid.

Manifolds can be provided with a wide range of further alternative modules. For example, a manifold may be provided with a module which has the sole purpose of taking fluid and/or flow measurements (such as temperature and pressure measurements and/or flow rate measurements), or a multi-purpose module which is able to fulfil a fluid and/or flow measurement functionality whilst also providing a flow access location for a further piece of process equipment to access the flow in the manifold.

Figure 3A:
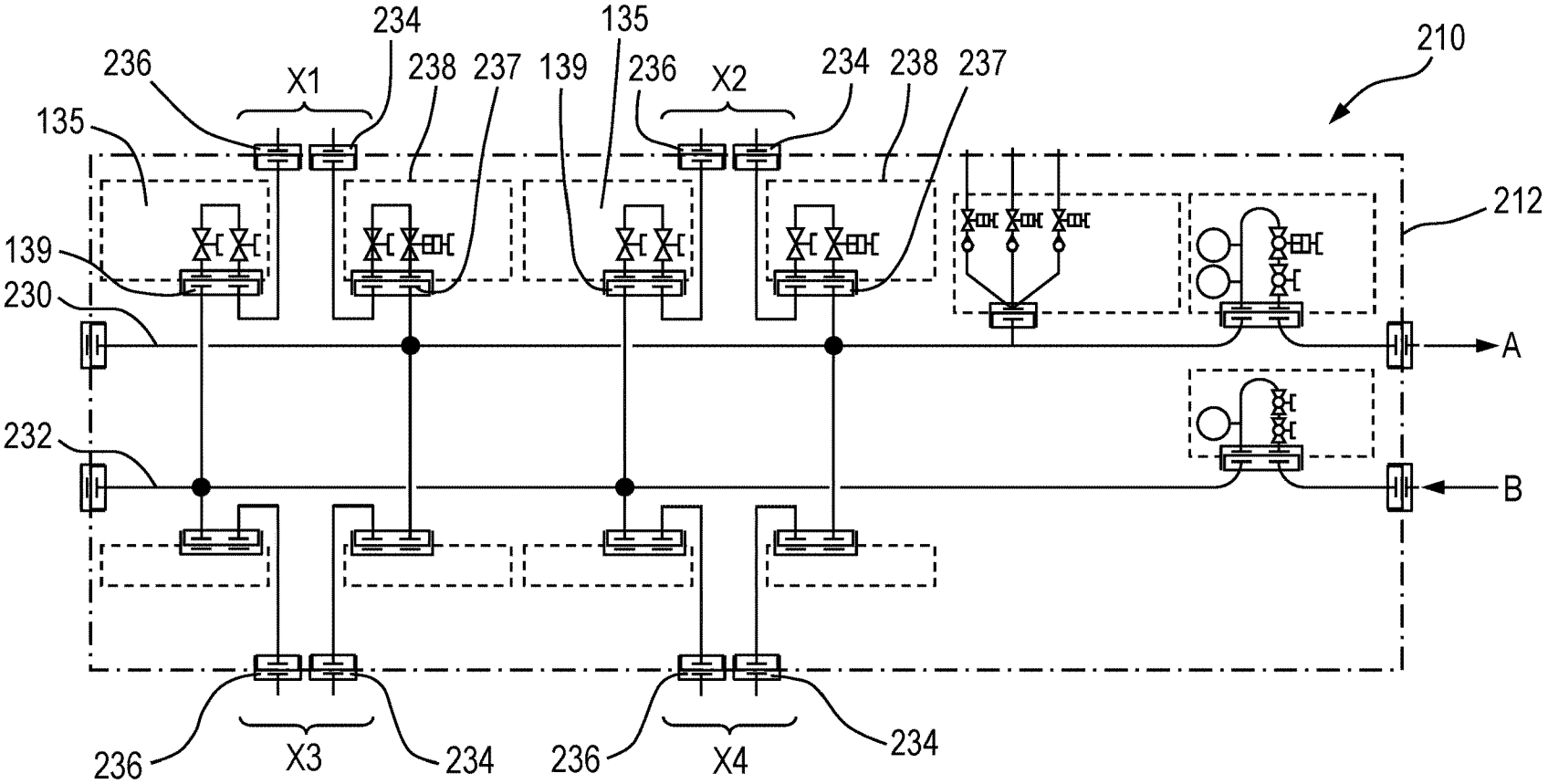
FIG. 3A is a schematic plan view of a subsea manifold according to an alternative embodiment of the invention.

Referring now to FIG. 3A, there is shown a manifold according to a further alternative embodiment of the invention, generally depicted at 210, The manifold 210 is similar to the manifold 110, and like components are indicated by like reference numerals incremented by 100. The manifold 210 differs from the manifold 110 in that it is a so-called "single header" manifold, which comprises only one main production flowline header 230. As such, the manifold requires only a dual-bore removable module 238, as production fluid is can only be routed to a single production flowline header 230.

Figure 3B:
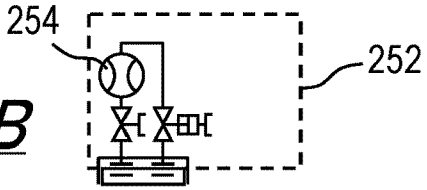
FIG. 3B is a schematic view of a removable module according to an alternative embodiment of the invention.

FIG. 3B shows an alternative module 252 which could be used in place of the dual-bore removable module 238 shown in FIG. 3A. The module 252 differs from the module 238 in that it also comprises a multi-phase flow meter 354 to provide the manifold with the additional functionality of performing flow rate measurements for individual phases of the production fluid.

Figure 4A:
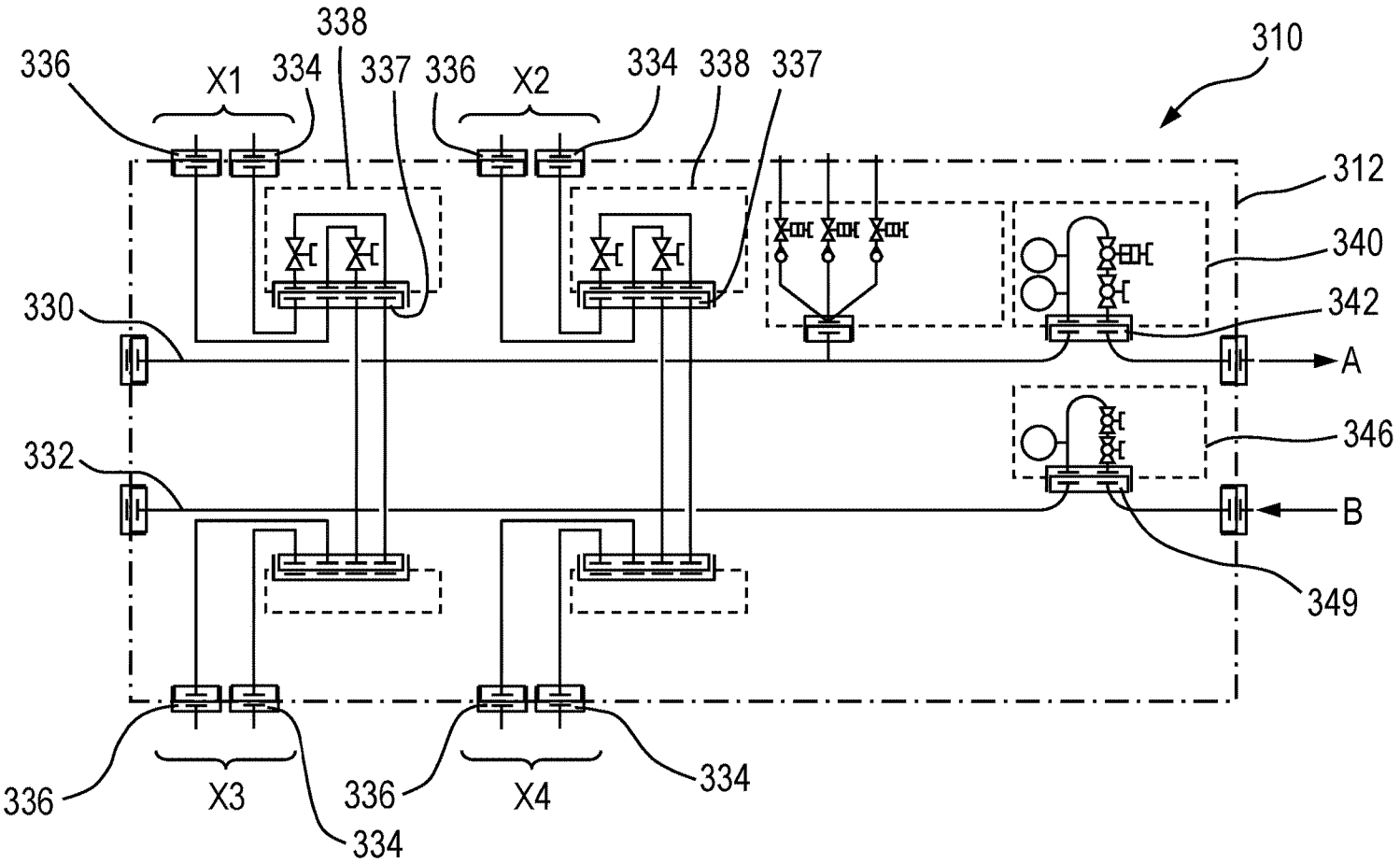
FIG. 4A is a schematic plan view of a subsea manifold according to an alternative embodiment of the invention.
Figure 4B:
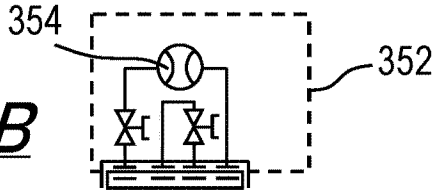
FIG. 4B is a schematic view of a removable module according to an alternative embodiment of the invention.

Referring now to FIG. 4A, there is shown a manifold according to a further alternative embodiment of the invention, generally depicted at 310, The manifold 310 is similar to the manifold 110, and like components are indicated by like reference numerals incremented by 200. The manifold 310 differs from the manifold 110 in that it is a so-called "lean single header" manifold, which comprises only one main production flowline header 330.

A further difference between the manifolds 110 and 310, is that in the manifold 310 production fluid flowing from a well and gas flowing from the gas lift flowline header are routed through a shared removable module 338 which is located on a quad-bore access point 337.

FIG. 3B shows an alternative module 352 which could be used in place of the quad-bore removable module 338 shown in FIG. 3A. The module 352 differs from the module 338 in that it also comprises a multi-phase flow meter 354 to provide the manifold with the additional functionality of performing flow rate measurements for individual phases of the production fluid.

In accordance with embodiments described above, the invention extends to apparatus in which a removable module contains a sensor package, for example for measuring pressure and/or temperature using transducers in the module (for example, the removable module 14 of FIG. 1). However, also as described above, modules with other functions or with multiple functions, including but not limited to the provision of a fluid intervention path, are also within the scope of the invention.

Figure 5:
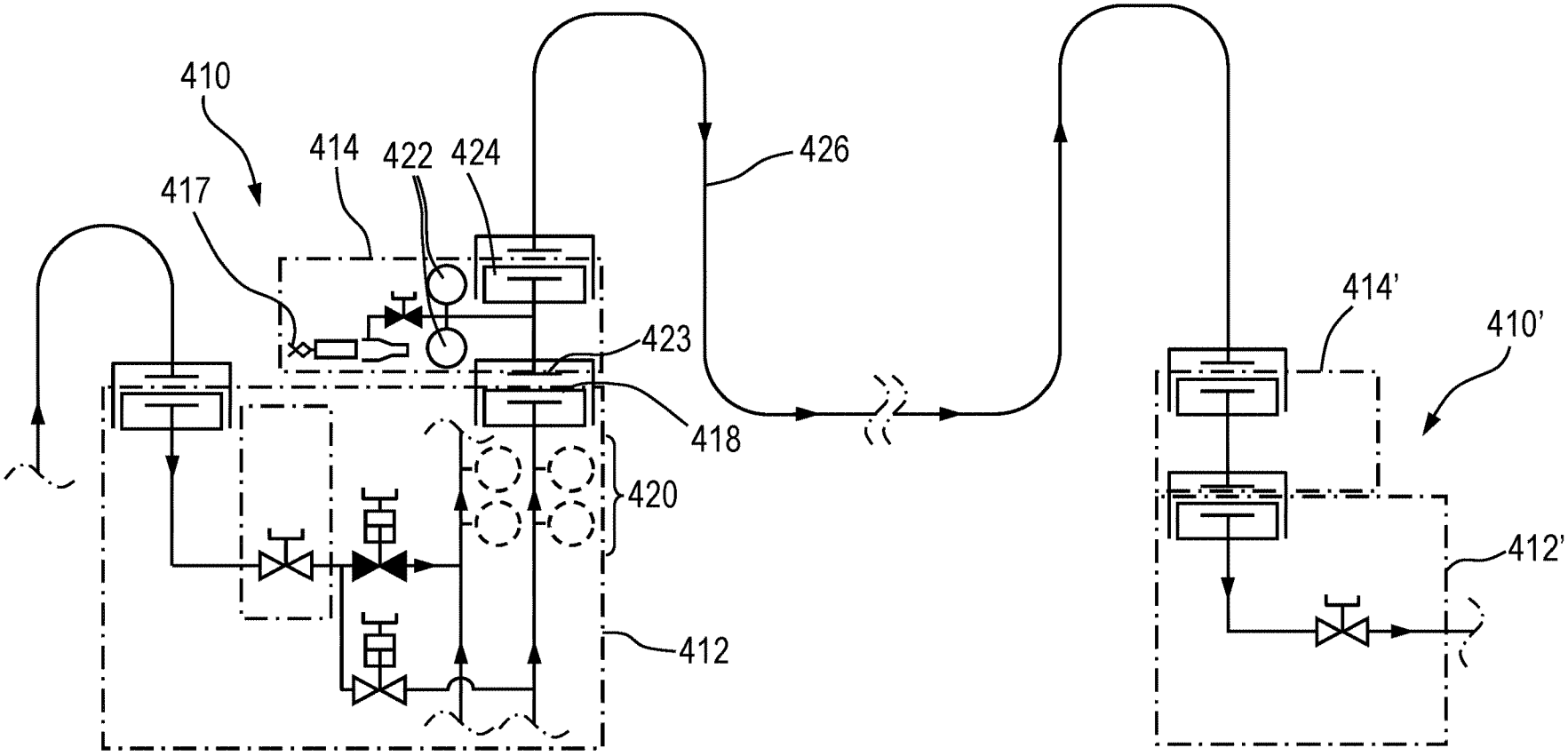
FIG. 5 is a schematic side view of a subsea production system according to a first embodiment of the invention.

FIG. 5 shows a manifold according to a further alternative embodiment of the invention. The manifold 410 is similar to the manifold 10 of FIG. 1 and like components are indicated by like reference numerals incremented by 400. Like the manifold 10, the manifold 410 comprises a main manifold structure 412 and a removable module 414. However, the removable module 414 differs from that of FIG. 1 in that it is a multi-purpose removable module.

Like the module 14 of FIG. 1, the module 414 comprises pressure/temperature transducers 422. However, the module 414 also includes an access point 417 for hydraulic intervention operations. In the embodiment shown, the hydraulic intervention flow access point 417 is an ROV hot stab connector. However, it will be appreciated that alternative intervention means may be provided. Therefore, the module 414 can fulfil a fluid measurement functionality (by providing fluid temperature and/or pressure measurements of the fluid) as well as providing an additional flow access functionality for hydraulic intervention operations.

Another difference between the systems of FIGS. 1 and 5 is that the flowline 426 is a flexible jumper flowline. To install the removable module between the main manifold structure 412 and the jumper flowline 426, the jumper flowline is disconnected from the manifold structure and parked elsewhere. That is, it is temporarily moved to an alternative location (typically at or near the manifold; however, it could be moved further away from the manifold if required or replaced altogether). The module 414 is then installed on to the manifold 418 with the assistance of an ROV, which makes up the connection between an external connector of the manifold 418 (to which the jumper flowline 426 was previously connected) and a first connector 423 of the module 414. A second connector 424 of the module 414 is a male×female jumper connector which allows the existing jumper flowline 426 to be re-installed on the module 414.

In use, production flow is routed through the jumper flowline 426 upon exiting the manifold 410 comprising the main manifold structure 412 and removable module 414, and in to a further manifold 410'. The further manifold 410' is a Pipe Line End Termination (PLET) similar to that for FIG. 1. Although the flowline 426 is a flexible flowline, the spacer module 414' may still be provided, whether or not it is required for flowline geometry reasons. However, it will be appreciated that the spacer removable module may be omitted or replaced with a removable module which is able to perform one or more functions.

Figure 6A:
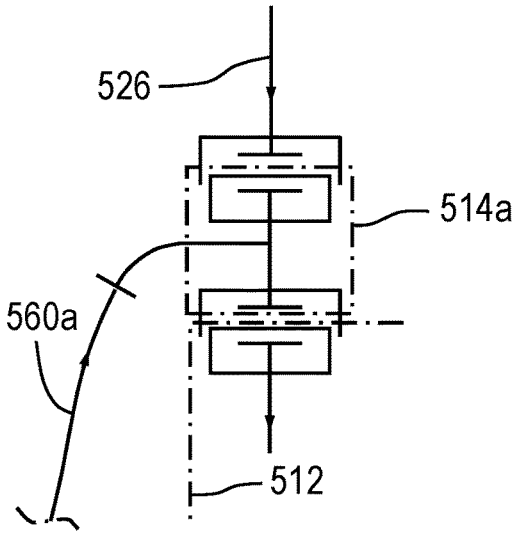
FIGS. 6A to 6C are schematic side views of a subsea production system according to a first embodiment of the invention.
Figure 6B:
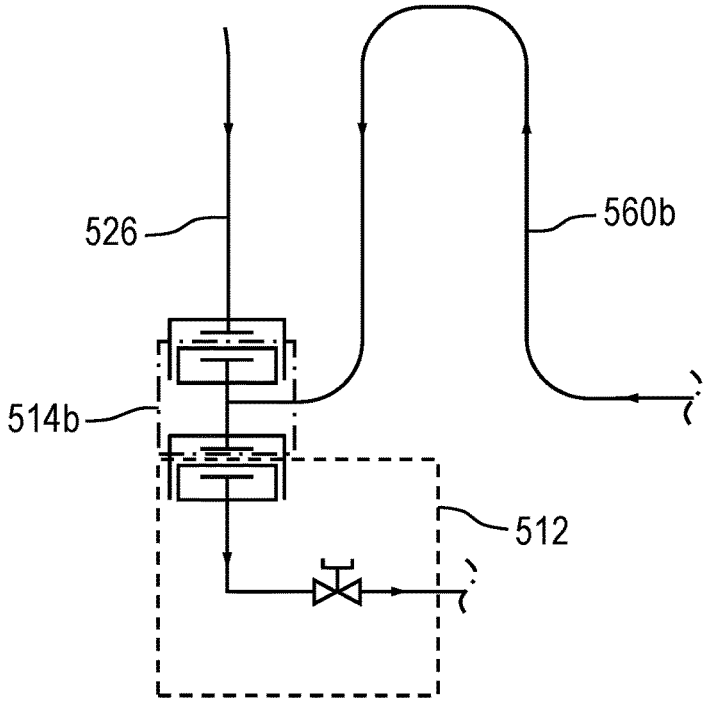
Figure 6C:
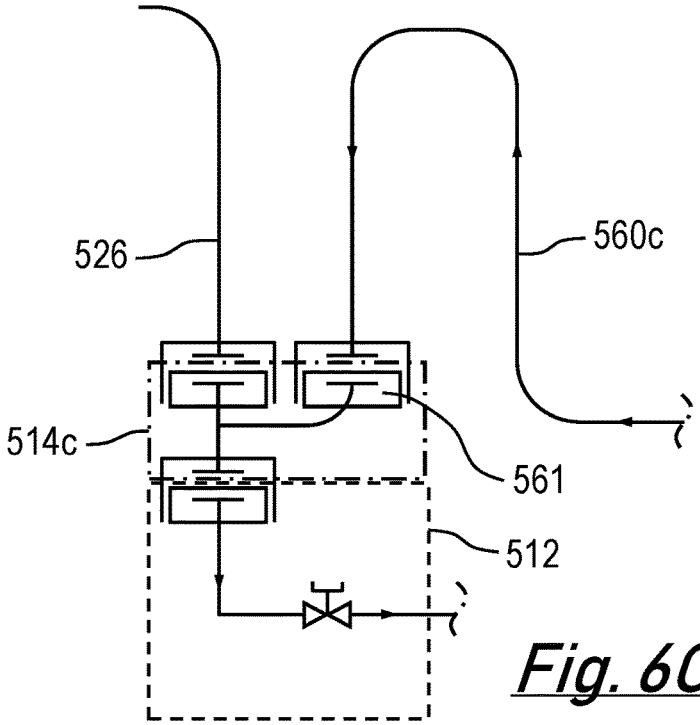

For example, FIGS. 6A to 6C show alternative configurations of the spacer module. In the configurations shown, an additional subsea well can be connected to the flow system via the spacer module. The spacer modules 514*a*, 514*b*, 514*c* are similar to the spacer module 414', and like components are indicated by like reference numerals incremented by 100.

FIG. 6A shows an additional subsea well being connected to the system via a flexible jumper flowline 560*a*. FIG. 6B alternatively shows an additional well being connected via a rigid jumper flowline 560*b*. The modules can also be connected to composite flowlines or jumper flowlines, or a combination of flexible, rigid and composite jumper flowlines. In both of FIGS. 6A and 6B, the jumper flowlines are connected to the spacer modules horizontally.

In the configuration of FIG. 6C, the spacer module provides a dedicated vertical connector 561 for the jumper flowline 560*c*, to receive flow from the additional well.

Although specific configurations and arrangements are described in the foregoing description, it will be appreciated that the spacer module can be installed between any manifold and flowline within a subsea system, such as between an external opening on the manifold (for example a flowline connector for a jumper flowline) and a jumper flowline. Not only can the spacer modules be installed on a variety of manifolds, they can also be connected at the riser base. Spacer modules can be connected to oil production, gas production, gas injection, gas lift, water injection and utilities and/or service lines, and can be utilised for a multitude of purposes including sensor installation, flowline access, and new well tie-in and connection.

Although in the foregoing description the invention is described with reference to a well gathering manifold, it will be understood that application of the invention is also relevant to alternative manifold configurations and in particular to distributed manifolds, such as an in-line tee. In such an application, a simple and paired back manifold base structure is provided (i.e. an in-line tee structure with no, or minimal, valving, instrumentation and equipment), with all additional functional elements being provided in one or more manifold removable modules.

The invention provides a subsea manifold for a subsea production system comprising at least one removable module, and methods of installation and use. The at least one removable is configured to perform a function selected from the group comprising: fluid control, fluid sampling, fluid diversion, fluid recovery, fluid injection, fluid circulation, fluid measurement and/or fluid metering.

Various modifications to the above-described embodiments may be made within the scope of the invention, and the invention extends to combinations of features other than those expressly claimed herein.

The invention claimed is:

1. A method of connecting a new subsea well to a subsea production system, the method comprising:

providing a subsea well, a subsea production flow system and a subsea manifold, the subsea manifold comprising:

a first connector;

a second connector fluidly connected to the subsea production flow system;

a flowline header in fluid communication with the second connector;

a fluid access point located between the first connector and the flowline header and having first and second flow access openings; and a first flow path between the first connector and the first flow access opening of the fluid access point and a second flow path between the second flow access opening of the fluid access point and the flowline header;

wherein the fluid access point is provided with a flow cap configured to prevent flow between the first and second fluid access openings;

fluidly connecting the subsea well to the first connector of the subsea manifold;

removing the flow cap from the fluid access point of the subsea manifold; and connecting a removable module to the fluid access point of the manifold, the removable module comprising a first flow path connecting the first and second fluid access openings such that the subsea well and the subsea production flow system are fluidly connected by the removable module.

2. The method according to claim 1, wherein the subsea well is fluidly connected to the first connector of the subsea manifold by a jumper flowline.

3. The method according to claim 1, wherein the removable module comprises: a body, a first connector and a second connector;

wherein the first and second connectors are connected to the first and second flow access openings of the access point of the subsea manifold, respectively; and wherein the first flow path is defined between the first connector and the second connector fluidly connecting the subsea well and the flowline header.

4. The method according to claim 3, wherein the removable module comprises further connectors and/or flow paths.

5. The method according to claim 3, wherein the first flow path and/or further flow paths of the removable module comprise one or more valves.

6. The method according to claim 1, wherein the removable module further comprises equipment and/or instrumentation configured to perform one or more functions selected from the group comprising: fluid control, fluid sampling, fluid diversion, fluid recovery, fluid injection, fluid circulation, fluid access, fluid measurement, flow measurement and/or fluid metering.

7. The method according to claim 1, wherein the subsea manifold is a subsea Christmas tree, a subsea collection manifold system, a subsea well gathering manifold, a subsea distributed manifold system (such as an in-line tee (ILT)), a subsea Pipe Line End Manifold (PLEM), a subsea Pipe Line End Termination (PLET) and/or a subsea Flow Line End Termination (FLET).

8. The method according to claim 1, wherein the first connector of the subsea manifold is configured to receive production fluid from the subsea well and/or route a fluid into the subsea well.

9. The method according to claim 1, wherein the first connector of the subsea manifold is configured to deliver gas into the subsea well for gas lift operations.

10. The method according to claim 1, wherein the second connector of the subsea manifold is connected to an export production flowline of the flow system and/or a gas delivery flowline.

11. The method according to claim 1, wherein the manifold comprises a plurality of flowline headers.

12. The method according claim 1, wherein the removable module comprises at least one valve in the first flow path and wherein the method comprises controlling flow between the subsea well and the subsea production flow system by operating the at least one valve to selectively permit fluid to flow from the subsea well to the subsea production flow system and/or from the subsea production flow system to the subsea well.

13. The method according to claim 12, wherein the flowline header is a production flowline header and wherein the method comprises operating the at least one valve to control flow of production fluid from the subsea well to the production flowline header and subsea production system.

14. The method according to claim 12, wherein the flowline header is a gas lift flowline header and the method comprises operating the at least one valve to control flow of gas from the gas lift flowline header to the subsea well.

15. The method according to claim 1, wherein the fluid access point of the subsea manifold further comprises a third flow access opening, and wherein the manifold further comprises:

a third connector configured to be fluidly connected to the subsea production flow system;

a second flowline header in communication with the third connector; and a third flow path between the third flow access opening of the fluid access point and the second flowline header; and wherein the removable module further comprises a second flow path connecting the first and third fluid access openings such that the subsea well and the second flowline header are fluidly connected by the second flow path of the removable module.

16. The method according to claim 15, wherein the first flow path and/or the second flow path of the removable module comprises at least one valve and the method comprises operating the at least one valve in the first flow path and/or in the second flow path to control whether fluid from the subsea well flows into the first and/or the second production flowline headers.

17. The method according to claim 15, wherein the first and second flow paths of the removable module are fluidly connected.

18. The method according to claim 1, wherein the fluid access point of the subsea manifold further comprises third and fourth flow access openings, and wherein the manifold further comprises:

a third connector configured to be fluidly connected to the subsea well;

a fourth connector configured to be fluidly connected to the subsea production flow system;

a second flowline header in communication with the fourth connector;

a third flow path between the third connector and the third flow access opening of the fluid access point; and a fourth flow path between the fourth flow access opening of the fluid access point and the second flowline header; and wherein the removable module further comprises a second flow path connecting the third and fourth fluid access openings such that the subsea well and the second flowline header are fluidly connected by the second flow path of the removable module.

19. The method according to claim 18, wherein the flowline header is a production flowline header and the second flowline header is a gas lift flowline header.

20. The method according to claim 19, wherein the first flow path and/or the second flow path of the removable module comprises at least one valve and wherein the method comprises operating the at least one valve in the first flow path to selectively permit production fluid to flow from the subsea well to the subsea production flow system via the production flowline header and/or operating the at least one valve in the second flow path to selectively control the flow of gas flow from the gas lift flowline header to the subsea well.

* * * * *